US012303754B2

(12) United States Patent
Hailong

(10) Patent No.: US 12,303,754 B2
(45) Date of Patent: May 20, 2025

(54) GOLF BAG AND FRAME FOR GOLF BAG

(71) Applicant: Shanlong Co., Ltd., Tokyo-to (JP)

(72) Inventor: Shen Hailong, Tokyo-to (JP)

(73) Assignee: Shanlong Co., Ltd., Tokyo-to (JP)

( * ) Notice: Subject to any disclaimer, the term of this patent is extended or adjusted under 35 U.S.C. 154(b) by 65 days.

(21) Appl. No.: 18/366,716

(22) Filed: Aug. 8, 2023

(65) Prior Publication Data

US 2024/0335714 A1 Oct. 10, 2024

(30) Foreign Application Priority Data

Apr. 6, 2023 (KR) ..... 10-2023-0045168

(51) Int. Cl.
*A63B 55/53* (2015.01)

(52) U.S. Cl.
CPC ..... *A63B 55/53* (2015.10)

(58) Field of Classification Search
CPC ..... A63B 55/53; A63B 55/57; A63B 55/40; A63B 55/408
USPC ..... 206/315.8, 315.7
See application file for complete search history.

(56) References Cited

U.S. PATENT DOCUMENTS

| | | | | |
|---|---|---|---|---|
| 1,693,889 | A | 4/1928 | Dick | |
| 1,954,413 | A | 10/1934 | Hunter | |
| 2,661,174 | A | 1/1953 | Walter | |
| 4,778,136 | A | 10/1988 | Reimers | |
| 5,605,310 | A | 2/1997 | Jungkind | |
| 6,296,116 | B1 | 10/2001 | Schmidt et al. | |
| 6,652,045 | B1 | 11/2003 | Jungkind | |
| 9,305,313 | B2 * | 4/2016 | Wu | G06F 3/0485 |
| 2003/0168362 | A1 * | 9/2003 | Yoshida | A45F 3/08 206/315.7 |
| 2004/0178094 | A1 * | 9/2004 | Reimers | A63B 55/408 206/315.3 |

FOREIGN PATENT DOCUMENTS

| | | | |
|---|---|---|---|
| JP | 3897693 | B2 | 3/2007 |
| JP | 2022-021128 | F | 2/2023 |
| JP | 7324552 | B1 | 8/2023 |
| KR | 10-2001-002142 | A | 1/2007 |

* cited by examiner

*Primary Examiner* — Sue A Weaver
(74) *Attorney, Agent, or Firm* — ZION IP; Byungwoong Park

(57) ABSTRACT

A golf bag includes a golf bag body into which a golf club is inserted; a frame body supporting the golf bag body with an opening of the golf bag body located on an upper side; a pair of legs rotatably supported on one side of the frame body to switch between a stand-by position and a deployed position where the pair of legs are capable of supporting the frame body; a manipulation member installed at the upper portion of another side of the frame body so as to be switchable in a predetermined direction; and a transmission member at least partially extending along a side edge of the opening, so that the legs can be switched from the stand-by position to the deployed position by switching the manipulation member.

8 Claims, 13 Drawing Sheets

GOLF BAG AND FRAME FOR GOLF BAG

TECHNICAL FIELD

The present disclosure relates to a golf bag and a frame for a golf bag.

BACKGROUND

It is publicly known that a golf bag for accommodating golf clubs is provided with a support member capable of realizing the accommodation. For example, Patent Document 1 discloses a related art. The golf bag of Patent Document 1 is provided with a body in which golf clubs are accommodated, and a frame into which the body can be put.

The frame is provided with a pressing member rotatably installed on the bottom, and a support member (stand) rotatably connected to the frame.

When the golf bag is tilted to one side, the pressing member installed on the bottom is pressed by the ground. This causes the support member to be pressed via an elastic member, which in turn rotates the support member to protrude from the frame, thereby being switched to an open state.

When the user brings the front end of the support member into contact with the ground with the support member being in the open state, the golf bag is supported by the support member in an inclined state with respect to the ground.

DOCUMENT OF RELATED ART

Patent Document (Patent Document 1) JP 3897693 B2

SUMMARY

However, it cannot be predicated that the ground on which the golf bag is placed is flat. Due to this, it is concerned that even if the golf bag of Patent Document 1 is tilted to one side, the support member (leg) is not opened because the pressing member is not sufficiently pressed depending on the ground condition.

In view of the background art described above, it becomes an object of the present disclosure to provide a golf bag and a frame for a golf bag, the golf bag having legs which can be switched to a deployed position where they support the golf bag body, and which a user can easily switch to the deployed position.

In order to achieve the aforementioned object, an embodiment of the present disclosure provides a golf bag including: a golf bag body into which a golf club is inserted; a frame body supporting the golf bag body with an opening of the golf bag body located on an upper side; a pair of legs rotatably supported on one side of the frame body to switch between a stand-by position and a deployed position where the pair of legs are capable of supporting the frame body; a manipulation member installed at the upper portion of another side of the frame body so as to be switchable in a predetermined direction; and a transmission member at least partially extending along a side edge of the opening, so that the legs may be switched from the stand-by position to the deployed position by switching the manipulation member.

According to this embodiment, since the manipulation member capable of switching the legs to the deployed position is installed on the upper portion of the frame body, it is possible to provide the golf bag having the legs which a user may easily switch to the deployed position.

Further, since the transmission member extends along the side edge of the opening, it is possible to prevent the opening from being narrowed by the transmission member.

In the above-described embodiment, preferably, the frame body includes an upper frame extending along the side edge of the opening of the golf bag body, and wherein the transmission member has a wire-like shape extending along the upper frame.

According to this embodiment, since the transmission member is arranged along the upper frame extending along the opening, it is possible to prevent the opening from being narrowed by the transmission member.

In the above-described embodiment, preferably, the upper frame is constructed with a hollow pipe member, and wherein the transmission member is inserted into and passes through the inside of the upper frame.

According to this embodiment, it is possible to prevent the opening from being narrowed by the transmission member.

In the above-described embodiment, preferably, the upper frame has a pair of left and right frames disposed on the left and right sides, and wherein the manipulation member is supported on both of the left and right frames between the left and right frames so as to be switchable between a front position where the legs are in the stand-by position and a rear position where the legs are in the deployed position.

According to this embodiment, it is possible to provide a golf bag having the manipulation member which a user may easily manipulate, and having high design flexibility.

In the above-described embodiment, preferably, the transmission member is connected to the legs at its both ends, and is hung to the manipulation member.

According to this embodiment, the two legs may be switched to the deployed position by the switching of one manipulation member.

In the above-described embodiment, preferably, a post extending downward is installed at an end of said another side of the upper frame, and wherein the manipulation member and the post are connected via a grip member.

According to this embodiment, the legs may be easily manipulated by gripping the grip member.

In the above-described embodiment, preferably, the manipulation member is provided with a grip portion extending downward from an end of said another side.

According to this embodiment, the legs may be easily manipulated by gripping the grip member.

In the above-described embodiment, preferably, the frame body is further provided with an elastic pressing member for elastically pressing the legs toward the stand-by position.

According to this embodiment, even when the golf bag is slightly tilted, the legs are maintained in the deployed position by the elastic pressing force of the elastic pressing member. Because of this, it is possible to prevent the legs from being unintentionally switched to the stand-by position at the time of carrying the golf bag, for example.

In order to achieve the aforementioned object, an embodiment of the present disclosure provides a frame for a golf bag including a frame body supporting a golf bag body with an opening of the golf bag body located on an upper side, wherein a golf club is inserted into the golf bag body; a pair of legs rotatably supported on one side of the frame body to be switchable between a stand-by position and a deployed position where the pair of legs are capable of supporting the frame body; a manipulation member installed at the upper portion of another side of the frame body so as to be switchable in a predetermined direction; and a transmission member at least partially extending along a side edge of the opening, so that the legs may be switched from the stand-by position to the deployed position by switching the manipulation member.

According to this embodiment, since the manipulation member for switching the legs to the deployed position is installed on the upper portion of the frame body, it is possible to provide the frame for a golf bag having the legs which a user may easily switch to the deployed position. Further, since the transmission member extends along the side edge of the opening, it is possible to prevent the opening from being narrowed by the transmission member.

According to the above-described embodiments, it is possible to provide a golf bag and a frame for a golf bag, the golf bag having legs which may be switched to the deployed position where they support the golf bag body, and which a user may easily switch to the deployed position.

DETAILED DESCRIPTION OF EXEMPLARY EMBODIMENTS

Hereinafter, embodiments of a golf bag and a frame for a golf bag according to the present disclosure will be described with reference to the accompanying drawings.

A golf bag 1 is commonly used by a user to carry his/her golf clubs. Hereinafter, the golf bag 1 will be described by way of example under the condition that it constitutes a so-called caddie bag.

First Embodiment

Figure 1:
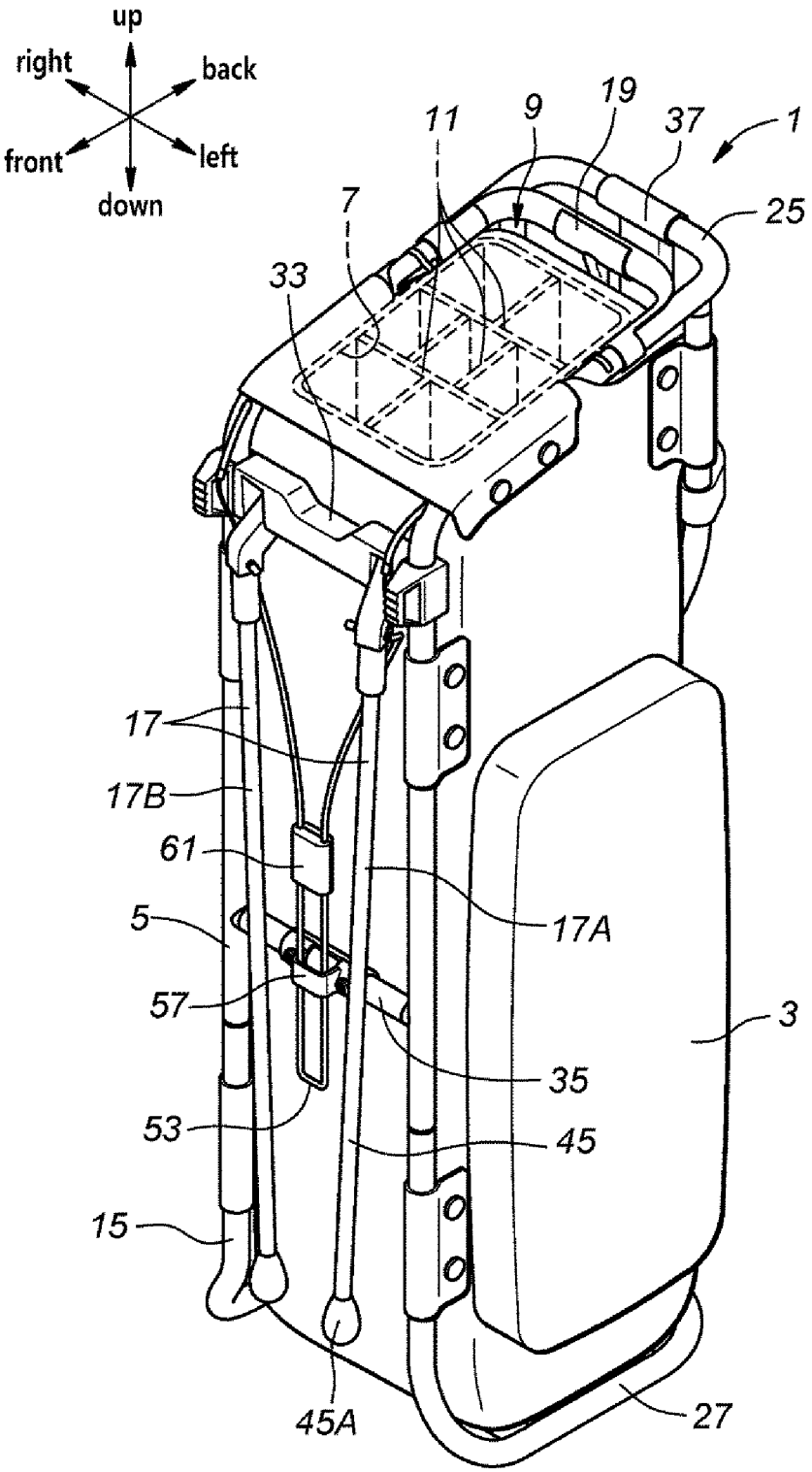
FIG. 1 is a perspective view of a golf bag according to a first embodiment.

As shown in FIG. 1, the golf bag 1 has a golf bag body 3 and a frame 5.

The golf bag body 3 is formed in a bag shape with an opening 7. The golf bag body 3 may be constructed with a fabric member having flexibility. The golf bag body 3 is fixed to the frame 5 at proper points so that it forms a container shape with a bottom. The golf club is inserted into the inside of the golf bag body 3 through the opening 7 by the user, and is stored in the golf bag body 3. On the outer peripheral surface of the golf bag body 3, may a strap for shoulder carry or a storage part for storing a ball, tee, marker, or the like, neither of which is shown, be installed.

Hereinafter, for convenience of explanation, the description will be made referring to the up and down directions determined based on the state in which the golf bag body 3 is positioned with its opening 7 located at the upper side, as shown in FIG. 1. However, these directions are defined for convenience of explanation, and the present disclosure is not limited by the description of these directions.

In the opening 7 of the golf bag body 3, an annular mouth frame 9 may be installed. The mouth frame 9 may be covered with a fabric member. Additionally, the golf bag body 3 may be provided with plate-shaped partition wall 11 for partitioning the inside thereof. The partition wall 11 may have any shape as long as it can partition the inside of the golf bag body 3.

Figure 2:
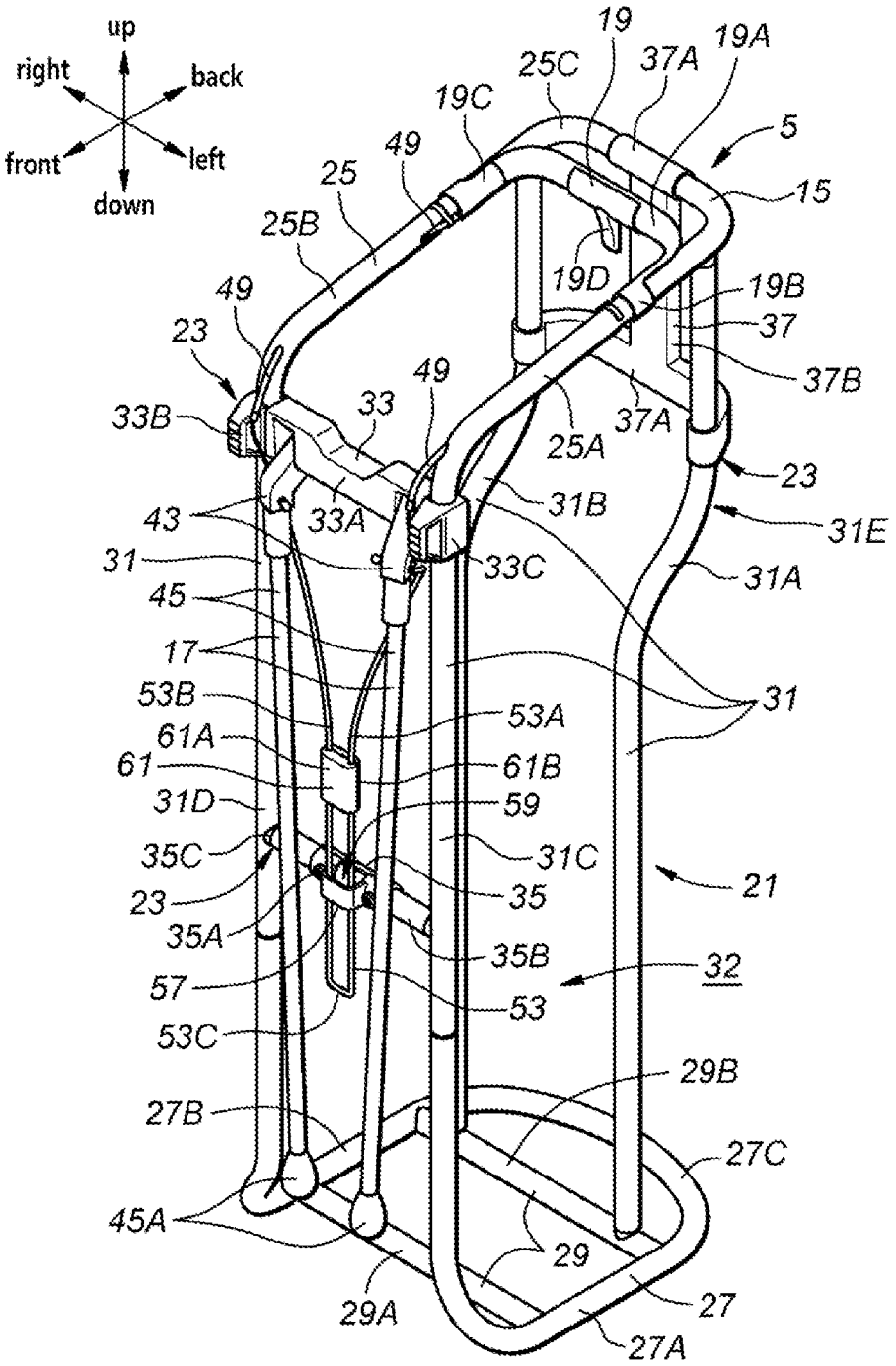
FIG. 2 is a perspective view of the frame when the legs are in the stand-by position.

As shown in FIG. 2, the frame 5 includes a frame body 15, and legs 17 and a manipulation member 19 which are installed to the frame body 15.

Hereinafter, as shown in FIGS. 1 and 2, the side of the frame 5 on which the legs 17 are installed is set as the front, and the description will be made referring to the front, back, left and right directions, each defined based on this. However, these directions are defined for convenience of explanation, and the present disclosure is not limited by the description of these directions.

The frame body 15 forms the skeleton of the golf bag 1. As shown in FIG. 1, the golf bag body 3 is fixed to the frame body 15 at proper points, and the frame body 15 supports the golf bag body 3 so that the opening 7 is located on the upper side.

As shown in FIG. 2, the frame body 15 includes a primary part 21 constructed with a pipe member, and a secondary part 23 coupled to the primary part 21.

The primary part 21 includes an upper frame 25 constituting the upper portion, a lower frame 27 constituting the lower portion, a connecting portion 29 installed to the lower frame 27, and a plurality of posts 31 connecting the upper frame 25 and the lower frame 27. The upper frame 25 extends along the side edges of the opening 7 at the upper portion of the golf bag body 3, i.e., outside the diameter of the mouth frame 9, and forms a substantially U-like shape that opens toward a predetermined direction. The lower frame 27 extends along the lower edges of the golf bag body 3 outside the lower portion of the golf bag body 3, and forms a substantially U-like shape that opens toward the same direction as the upper frame 25.

The upper frame 25 has a left frame 25A, a right frame 25B, and a rear frame 25C. The left frame 25A and the right frame 25B each extend approximately in the front-back direction, and are arranged with a spacing therebetween in the left-right direction. The rear frame 25C connects the rear end of the left frame 25A and the rear end of the right frame 25B.

The lower frame 27 also has a left frame 27A, a right frame 27B, and a rear frame 27C. The left frame 27A and the right frame 27B each extend approximately in the front-back direction, and are arranged with a spacing therebetween in the left-right direction. The rear frame 27C connects the rear end of the left frame 27A and the rear end of the right frame 27B. In this embodiment, the distance between the left frame 27A and the right frame 27B of the lower frame 27 is greater than the distance between the left frame 25A and the right frame 27B of the upper frame 25, and the width of the lower frame 27 in the left-right direction is greater than the width of the upper frame 25 in the left-right direction.

The connecting portion 29 extends in the left-right direction, and is connected to the left frame 27A of the lower frame 27 at its left end and to the right frame 27B of the lower frame 27 at its right end. In this embodiment, the primary part 21 includes two connecting portions 29, i.e., a front connecting portion 29A and a rear connecting portion 29B, and the front connecting portion 29A and the rear connecting portion 29B are arranged side by side in the front-rear direction, respectively. The front connecting portion 29A and the rear connecting portion 29B connect the left frame 27A of the lower frame 27 and the right frame 27B of the lower frame 27, respectively.

The primary part 21 has four posts 31, i.e., a first post 31A, a second post 31B, a third post 31C, and a fourth post 31D. However, in the present disclosure, there is no restriction to the number of posts 31 that the primary part 21 has. The first post 31A and the second post 31B are side by side in the left-right direction, and the third post 31C and the fourth post 31D are arranged side by side in the left-right direction in front of the first post 31A and the second post 31B, respectively.

Each of the first post 31A and the second post 31B extends downward, are bent to extend obliquely forward and downward in a substantially central portion thereof, and then is bent again to extend downward.

In other words, the first post 31A and the second post 31B extend upward from the lower end, extend upward and rearward in the substantially central portion thereof, and then are bent again to extend upward.

Accordingly, each of the first post 31A and the second post 31B has a bulging portion 31E that bulges backward at the upper portion.

The first post 31A and the second post 31B are respectively coupled to the upper frame 25 at their upper ends, and are respectively coupled to the left and right ends of the rear connecting portion 29B at their lower ends.

The third post 31C and the fourth post 31D each extend in a substantially straight line in the up-down direction.

The third post 31C and the fourth post 31D each connect the left and right front ends of the upper frame 25 and the left and right front ends of the lower frame 27. However, the shapes of these posts 31 may be set based on the shape or size of the golf bag body 3.

An accommodating space 32 for accommodating the golf bag body 3 is defined by the upper frame 25, the lower frame 27, the first post 31A, the second post 31B, the third post 31C, and the fourth post 31D.

In this embodiment, the upper frame 25, the lower frame 27, the third post 31C and the fourth post 31D are constructed by connecting hollow pipe members subjected to the bending process so as to form a continuous form.

Each of the front connecting portion 29A and the rear connecting portion 29B is constructed by one pipe member, and is connected to the lower frame 27 at the left and right ends.

Each of the third post 31C and the fourth post 31D is also constructed by one pipe member, and is connected to the upper frame 25 at the upper end, and to the rear connecting portion 29B at the lower end.

The pipe members constituting the upper frame 25, the lower frame 27, the third post 31C, and the fourth post 31D may be connected by any method such as screw fastening, welding or the like.

In addition, the pipe members constituting the front connecting portion 29A, the rear connecting portion 29B, the third post 31C, and the fourth post 31D may also be connected to the upper frame 25 or the lower frame 27 by any method such as screw fastening, welding or the like.

In this embodiment, the primary part 21 is constructed by fitting and connecting parts made of aluminum or resin to an aluminum pipe member. Accordingly, it is possible to reduce the weight of the golf bag 1 while maintaining its strength.

The secondary part 23 is attached to the primary part 21 for the purpose of reinforcing the primary part 21 and constructing a functional part in the frame body 15. In this embodiment, the frame body 15 is provided with, as the secondary part 23, a first secondary part 33 and a second secondary part 35 installed on the front side of the frame body 15, and a third secondary part 37 installed on the rear side of the frame body 15.

The first secondary part 33 is installed on the upper front side of the primary part 21. The first secondary part 33 extends in the left-right direction to connect the upper portion of the third post 31C and the upper portion of the fourth post 31D.

In this embodiment, the first secondary part 33 includes a central portion 33A having a main surface facing forward, a left end portion 33B installed at the left end of the central portion 33A and coupled to the third post 31C, and a right end portion 33C installed at the right end of the central portion 33A and coupled to the fourth post 31D.

The first secondary part 33 may be constructed with a resin member, or may be constructed with a metal member.

In this embodiment, the first secondary part 33 is constructed with the resin member.

The second secondary part 35 is installed in the front center portion of the primary part 21.

The second secondary part 35 extends in the left-right direction to connect the central portion in the up and down direction of the third post 31C and the central portion in the up and down direction of the fourth post 31D.

In this embodiment, the second secondary part 35 includes a central portion 35A having a main surface facing forward, a left end portion 35B installed at the left end of the central portion 35A and coupled to the third post 31C, and a right end portion 35C installed at the right end of the central portion 35A and coupled to the fourth post 31D.

The second secondary part 35 may be constructed with a resin member, or may be constructed with a metal member.

In this embodiment, the second secondary part 35 is constructed with the metal pipe member.

The third secondary part 37 is installed on the rear side of the primary part 21. The third secondary part 37 is provided with a pair of horizontal side portions 37A extending in the left-right direction and arranged so as to form a pair, one above the other, and a vertical side portion 37B extending in the up-down direction and connected to approximately the central portions in the left-right direction of the horizontal side portions 37A at the upper and lower ends, respectively.

The upper horizontal side portion 37A is coupled to the rear frame 25C of the upper frame 25.

The upper horizontal side portion 37A is arranged so as to cover the outer peripheral surface of the rear frame 25C and be coupled to the rear frame 25C.

The lower horizontal side portion 37A is coupled to the first post 31A at the left end and coupled to the second post 31B at the right end.

The third secondary part 37 constitutes a grip part for a user to lift the golf bag 1.

In this embodiment, the third secondary part 37 is constructed with the resin member.

The frame 5 is provided with a pair of legs 17, which are located at the left and right side thereof, respectively.

Figure 3:
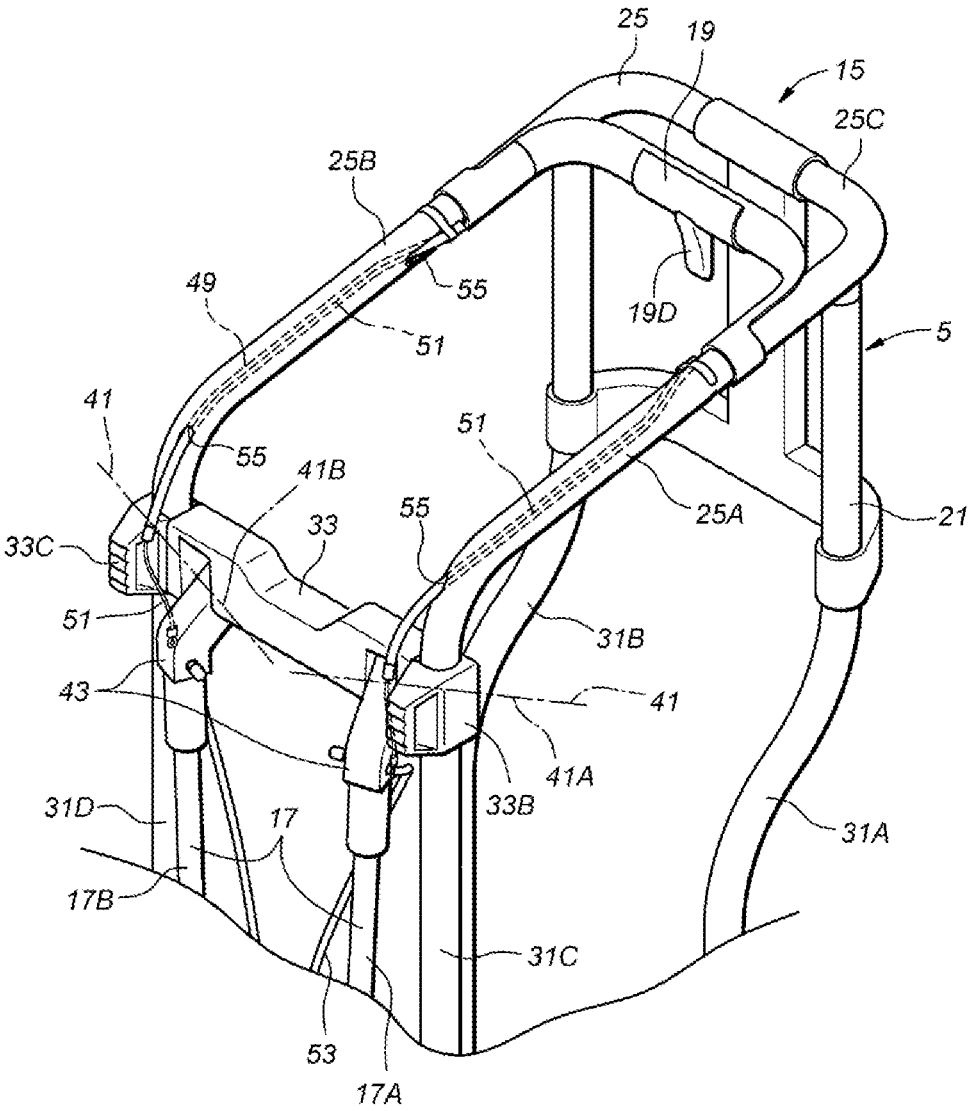
FIG. 3 is a front perspective view of the upper portion of the frame.
Figure 4:
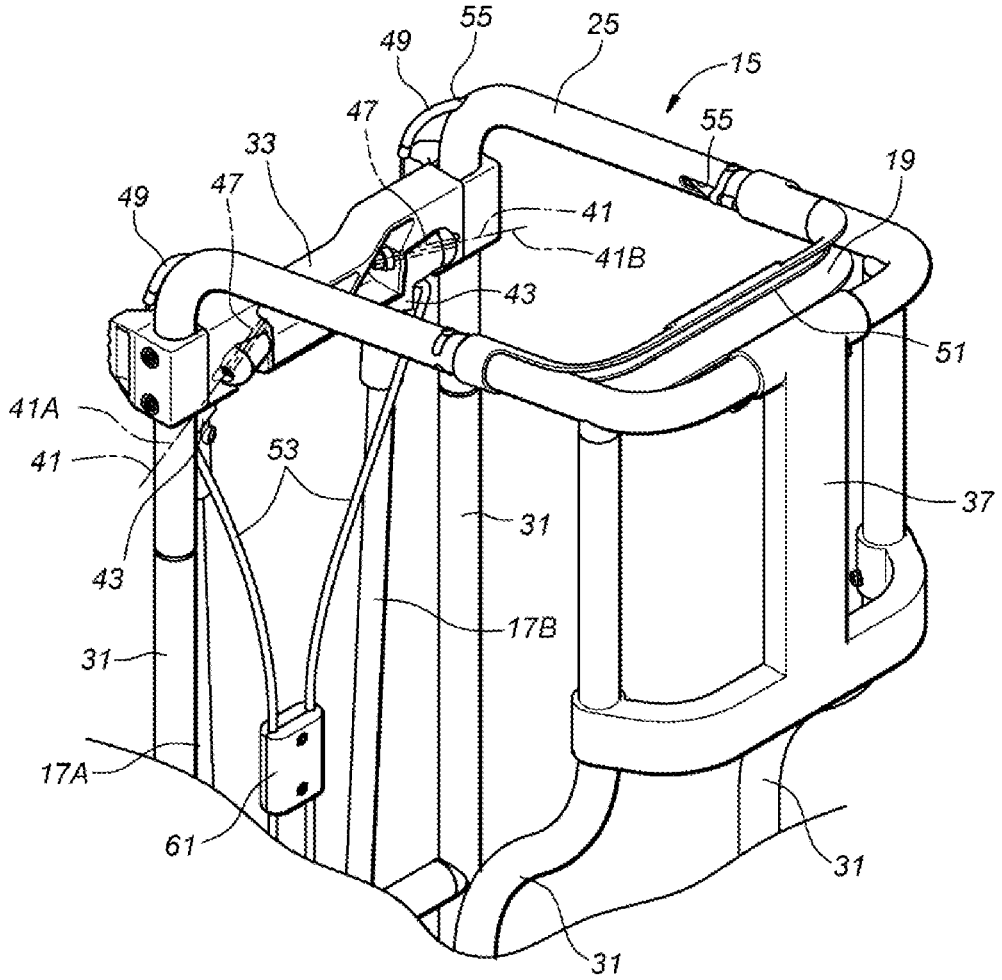
FIG. 4 is a rear perspective view of the upper portion of the frame.

As shown in FIGS. 3 and 4, each of the legs 17 is supported rotatably on the front side of the frame body 15.

Thus, the legs 17 are supported on the front side of the frame body 15 so that they can rotate about the rotational axes 41 at the upper ends, respectively.

In this embodiment, the rotational axis 41A of the leg 17 located on the left side (hereinafter, referred to as the left leg 17A) is set so as to extend in a left oblique forward direction, and the rotational axis 41B of the leg 17 located on the right side (hereinafter, referred to as the left leg 17B) is set so as to extend in a right oblique forward direction.

The left leg 17A is rotatably supported on the left portion of the front side of the frame body 15, and the right leg 17B is rotatably supported on the right portion of the front side of the frame body 15.

In this embodiment, the left leg 17A and the right leg 17B are constructed so as to achieve left-right symmetry.

In this embodiment, as shown in FIG. 2, each of the left leg 17A and the right leg 17B is provided with a connecting portion 43 rotatably connected to the front left or right portion of the first secondary part 33, and a leg body 45 formed in a straight pipe shape and connected to the connecting portion 43 at one end (upper end).

As shown in FIG. 4, the connecting portion 43 and the first secondary part 33 are connected by a support 47 extending along the rotational axis 41.

One end of the support 47 may be rotatably supported by the first secondary part 33, and the other end of the support 47 may be fixed to the connecting portion 43.

Accordingly, the connecting portion 43 and the first secondary part 33 are connected to each other so as to be able to rotate about the rotational axis 41.

In this embodiment, as shown in FIG. 2, the left leg 17A and the right leg 17B are each provided with sealing members 45A (caps), each provided at the other end (lower end) of the leg body 45 and sealing the opening portion of the leg body 45, respectively.

The leg body 45 may be constructed by a metal (e.g., aluminum) pipe member, and the sealing member 45A may be constructed with a resin member.

Figure 5:
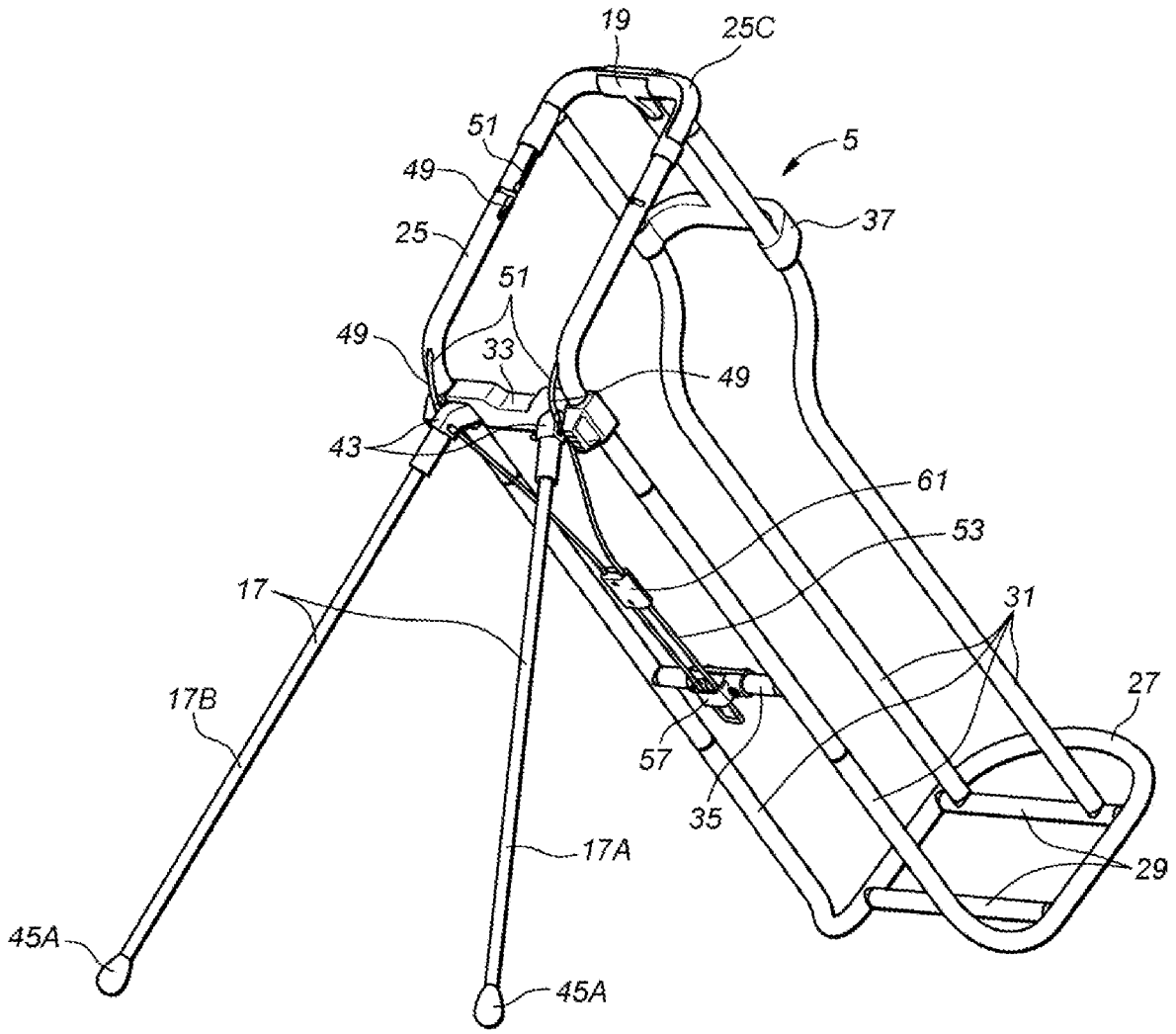
FIG. 5 is a perspective view of the frame when the legs are in the deployed position.

The legs 17 may each be switched by rotation between the stand-by position shown in FIG. 2 (also referred to as a closed position) and the deployed position shown in FIG. 5 (also referred to as an open position or an expanded open position).

When in the stand-by position, the legs 17 are each lowered and their lower ends are in a position proximate to the golf bag body 3.

Meanwhile, when in the deployed position, the lower end of each leg 17 is located further forward and spaced from the golf bag body 3 than when in the stand-by position.

When the legs 17 are in their deployed positions, and when the golf bag 1 is tilted so that the lower ends of the respective legs 17 come into contact with the ground, the frame 5 and golf bag body 3 are together supported by legs 17.

The lower end of the left leg 17A is located at a left front side when in the deployed position, compared to when in the stand-by position, and the lower end of the right leg 17B is located at a right front side when in the deployed position, compared to when in the stand-by position.

Accordingly, when the left leg 17A and the right leg 17B are both in the deployed position, the distance between the lower end of the left leg 17A and the lower end of the right leg 17B is greater than when the right leg 17B and the left leg 17A are both in the stand-by position.

The manipulation member 19 (also referred to as a lever or a handle) receives a user's manipulation input for switching the legs 17 from the stand-by position to the deployed position.

The manipulation member 19 is supported on the rear upper portion of the frame body 15 so as to be switchable in the front-rear direction (see FIGS. 2 and 5 also).

In this embodiment, as shown in FIG. 3, the manipulation member 19 is located between the left frame 25A and the right frame 25B of the upper frame 25.

The manipulation member 19 is supported at both left and right ends by the left frame 25A and the right frame 25B, respectively so as to be slidable in the front-rear direction.

In this embodiment, the manipulation member 19 has a central portion 19A extending in the left-right direction, a left end 19B which is in slidable contact with the right surface of the left frame 25A at the left end of the central portion 19A, and a right end 19C which is in slidable contact with the left surface of the right frame 25B at the right end of the central portion 19A.

In this way, the manipulation member 19 is installed so as to extend in the left-right direction between the left frame 25A and the right frame 25B (i.e., between the left and right frames).

With this, it is possible to construct the relatively large manipulation member 19, so that the user may easily hold the manipulation member 19 with his/her hand, thereby improving the operability of the manipulation member 19.

In addition, since the manipulation member 19 does not protrude out of the frame body 15, the design flexibility of the golf bag 1 may be improved.

Figure 6:
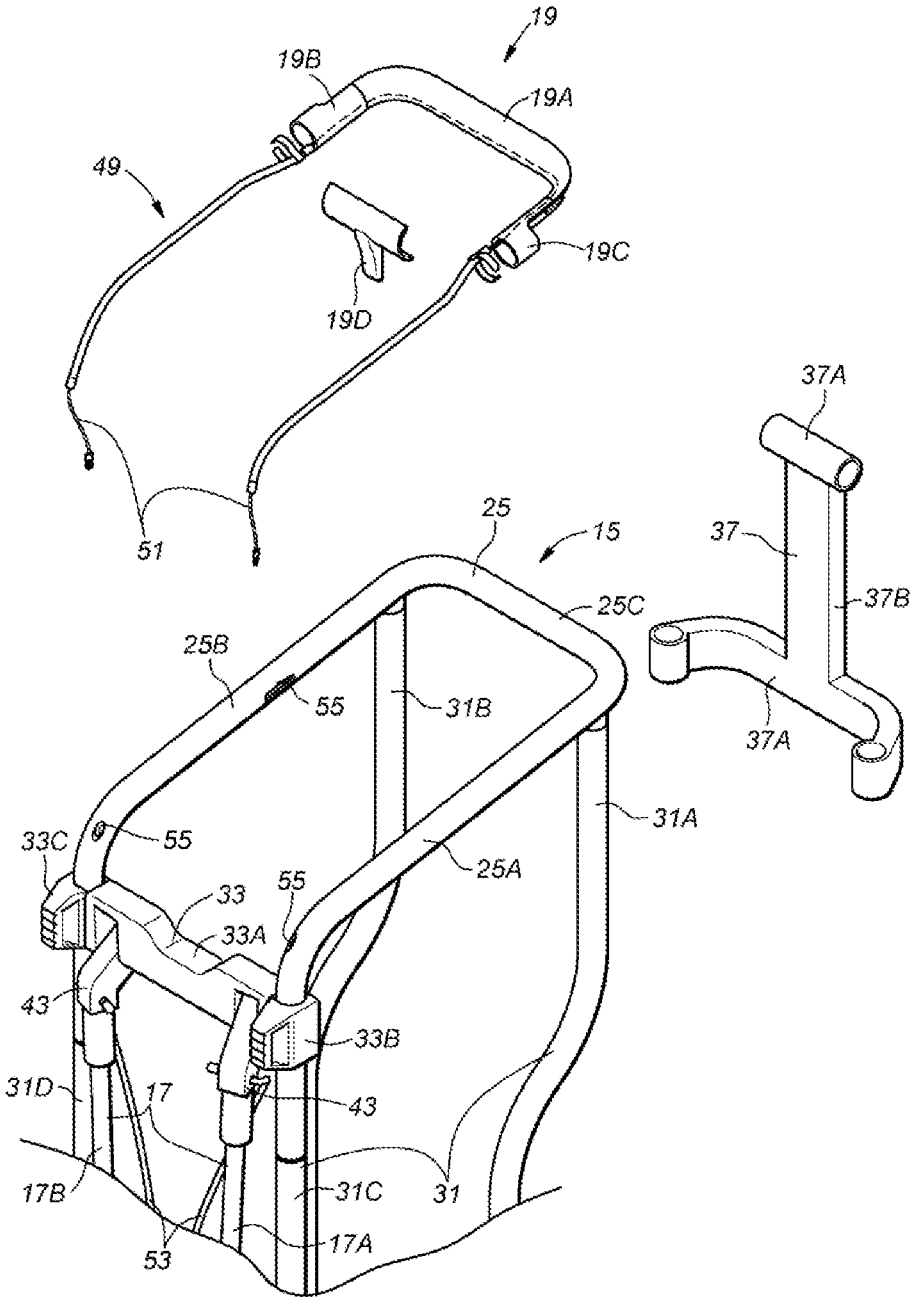
FIG. 6 is an exploded perspective view of the frame.

As shown in FIG. 6, the left end 19B has a tubular shape matching the right surface of the left frame 25A, and the right end 19C has a tubular shape matching the left surface of the right frame 25B.

As shown in FIG. 3, the left end 19B and the right end 19C are configured to be slidable on the left frame 25A and the right frame 25B, respectively.

A grip 19D (grip portion) for the user to hook and grip with his/her fingers may be installed on the front center portion of the center portion 19A.

By installing the grip 19D, the manipulation member 19 may be easily pulled backward, and so the legs 17 may be easily manipulated.

As shown in FIGS. 3 and 6, the frame 5 is provided with a transmission member 49 installed thereon, which transmits the manipulating force of the manipulation member 19 to each of the left and right legs 17. Specifically, when the manipulation member 19 is switched rearward, the transmission member 49 rotates each of the left and right legs 17, switching them from the stand-by position to the deployed position.

Hereinafter, the position of the manipulation member 19 when the leg 17 is in the stand-by position is referred to as a front position, and the position of the manipulation member 19 when the leg 17 is in the deployed position is referred to as a rear position.

The manipulation member 19 is supported between the left frame 25A and the right frame 25B so as to be switchable between the front position and the rear position.

As shown in FIG. 6, the transmission member 49 includes a connecting member 51 connecting the manipulation member 19 with the left leg 17A, and the manipulation member 19 with the right leg 17B.

The connecting member 51 may be constructed with one or more wires (it is also referred to as a string-like member and a cable).

In this embodiment, the transmission member 49 is constructed with a flexible cable (so-called Bowden cable) including a tubular outer casing and an inner cable housed inside the outer casing, wherein the inner cable corresponds to the connecting member 51.

As shown in FIG. 3, the both ends of the connecting member 51 are connected to the legs 17, respectively.

In this embodiment, the end of the connecting member 51 extends downward from the upper side of the rotational axis 41 past the front of the rotational axis 41, and is connected to the leg 17 (specifically, the connecting portion 43) below the rotational axis 41. Through this structure, the tensile force of the connecting member 51 causes the legs 17 to rotate, switching each of them from the stand-by position to the deployed position.

As shown in FIG. 4, the central portion of the connecting member 51 is coupled to the manipulation member 19 by being hung around the rear surface of the manipulation member 19.

As shown in FIG. 3, the coupling member 51 is arranged so that its sections between the ends and the central portion may be arranged along the upper frame 25 (specifically, the left frame 25A and the right frame 25B). Accordingly, the transmission member 49 (specifically, a portion of the transmission member 49) is disposed along the upper frame 25, and extends along the side edge of the opening 7 of the golf bag body 3.

In the left frame 25A and the right frame 25B of the upper frame 25, through-holes 55 for introducing the connecting member 51 therein are formed at proper points.

A portion of the connecting member 51 along the left frame 25A of the upper frame 25 enters the inside of the left frame 25A through the through-hole 55. Thus, at least a part of the portion of the connecting member 51 along the left frame 25A of the upper frame 25 is inserted into and pass through the left frame 25A of the upper frame 25.

A portion of the connecting member 51 along the right frame 25B of the upper frame 25 enters the inside of the right frame 25B through the through-hole 55.

At least a part of the portion of the connecting member 51 along the right frame 25B of the upper frame 25 is also inserted into and pass through the right frame 25B of the upper frame 25.

When the manipulation member 19 is moved from the front position (see FIG. 2) to the rear position (see FIG. 5), the central portion of the connecting member 51 is pulled rearward. Accordingly, both ends of the connecting member 51 are pulled backward, so the left and right legs 17 are rotated about the rotational axes 41, respectively, switching from the stand-by position to the deployed position.

As shown in FIG. 2, an elastic pressing member 53 is further installed in the frame 5.

The elastic pressing member 53 elastically presses the legs 17 towards the stand-by position.

The elastic pressing member 53 may be constructed with a torsional coil spring or other type of elastic member installed on the respective rotational axes 41 of the left and right legs 17.

The elastic pressing member 53 may be configured to elastically press the lower ends (outer ends) of the left and right legs 17 in a direction in which they get closer to each other.

When in the deployed position, the distance between the lower end of the right leg 17B and the lower end of the left leg 17A is greater than when in the standby position, and so, by elastically pressing the lower ends (outer ends) of the left and right legs 17 in a direction in which they get closer to each other, the right leg 17B and the left leg 17A are elastically pressed toward the stand-by position by the elastic pressing members 53, respectively.

In this embodiment, the elastic pressing member 53 is constructed with a solid rod-shaped metal member subjected to the bending process.

The rod-shaped member functions as an elastic member that elastically presses the lower ends (outer ends) of the left and right legs 17 in a direction in which they get closer to each other.

Specifically, the elastic pressing member 53 is provided with a left half portion 53A connected to the left leg 17A at the left end and extending right downward to the right, a right half portion 53B connected to the right leg 17B at the right end and extending downward to the left, and a central portion 53C extending in the left-right direction and connecting the lower end of the left half portion 53A and the lower end of the right half portion 53B.

The elastic pressing member 53 (specifically, the upper end of the left half portion 53A) is connected at the left end to the lower portion (lower end side) than the rotational axis 41 of the left leg 17A, and the elastic pressing member 53 (specifically, the upper end of the right half portion 53B) is connected at the right end to the lower portion (lower end side) than the rotational axis 41 of the right leg 17B.

When the left leg 17A and the right leg 17B each switch from the stand-by position to the deployed position, the upper end of the left half portion 53A and the upper end of the right half portion 53B are pulled away from each other.

For this reason, the elastic pressing member 53 exerts an elastic pressing force so that the upper end of the left half portion 53A and the upper end of the right half portion 53B get closer to each other.

Thus, the left leg 17A and the right leg 17B are elastically pressed so as to be in the stand-by position, respectively.

In this embodiment, both ends of the elastic pressing member 53 are inserted into through holes formed in the connecting portions 43, respectively, so that the elastic pressing member 53 is coupled to the connecting portions 43.

By coupling the connecting member 51 to the end of the elastic pressing member 53, the connecting member 51 is coupled to the connecting portion 43.

Figure 7:
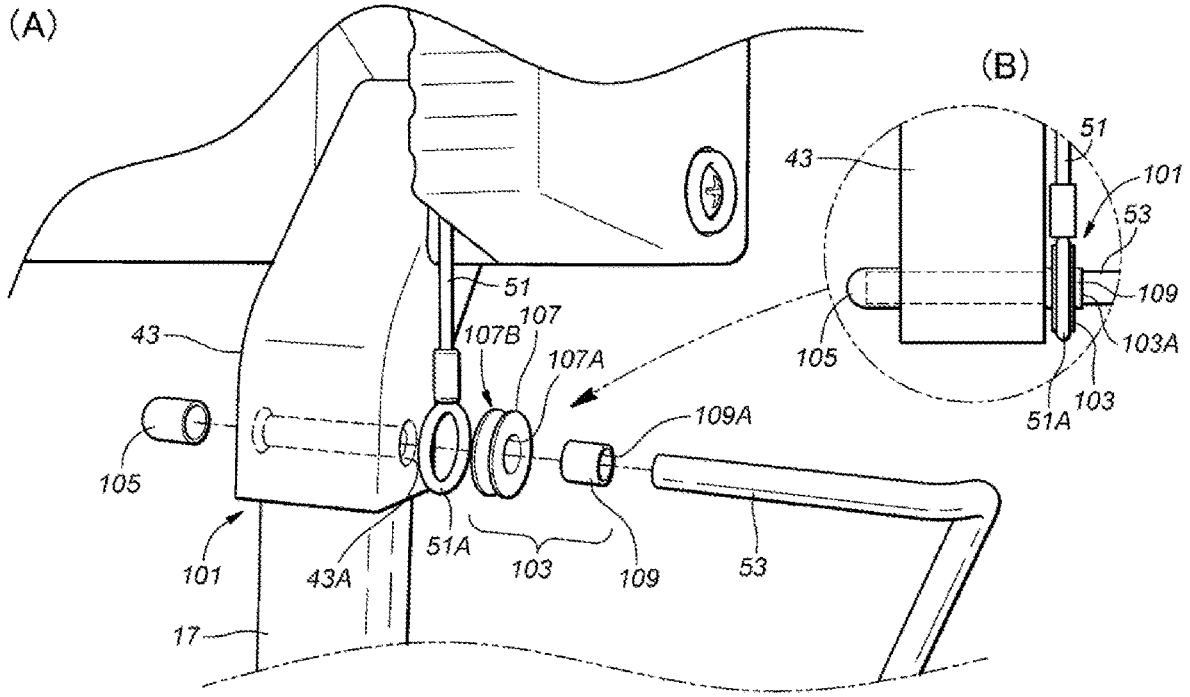
FIG. 7 is an exploded perspective view (A) of the coupling portion of the elastic pressing member 53 and the connecting portion 43 and a side view (B) of the coupling portion.

FIG. 7 shows an exploded perspective view (A) of a coupling portion 101 of the elastic pressing member 53 and the connecting portion 43 according to another embodiment and a side view (B—see inside the two-dot chain line) of the coupling portion 101.

In another embodiment shown in FIG. 7, a cylindrical collar 103 is installed in the coupling portion 101.

The end of elastic pressing member 53 passes through the inner hole 103A of the collar 103 and the through-hole 43A formed in the connecting portion 43 in this order.

A sealing member 105 is installed at the insertion end of the elastic pressing member 53.

Accordingly, it is possible to prevent the elastic pressing member 53 from being extracted out of the through-hole 43A of the connecting portion 43.

As shown in FIG. 7, the collar 103 includes a cylindrical collar body 107 having a through-hole 107A, and a cylindrical tube member 109 inserted into the through-hole 107A of the collar body 107.

The collar body 107 may be constructed with a rubber member.

The tube member 109 is constructed with a metal member.

An inner hole 109A of the tube member 109 is slightly greater than the outer diameter of the elastic pressing member 53.

The elastic pressing member 53 is inserted into the inner hole 109A of the tube member 109, and the sealing member 105 is installed at the insertion end, so that the collar 103 is rotatably supported at the end of the elastic pressing member 53.

A groove 107B is formed on the outer circumference of the collar body 107.

An annular locking portion 51A is coupled to an end of the connecting member 51.

As the locking portion 51A is received in the groove 107B of the collar body 107, the connecting member 51 is locked to the collar 103.

Accordingly, the connecting member 51 is coupled to the end of the elastic pressing member 53.

An accommodating portion 57 for accommodating the elastic pressing member 53 is installed in the second secondary part 35.

The accommodating portion 57 cooperates with the second secondary part 35 to constitute a pocket 59 accommodating a part of the lower portion of the elastic pressing member 53 (specifically, the lower portion of the left half portion 53A and the lower portion of the right half portion 53B).

By accommodating the part of the lower portion of the elastic pressing member 53 is accommodated in the pocket 59, the lower portion of the elastic pressing member 53 is prevented from being projected forward.

In addition, a retaining member 61 for maintaining the left half portion 53A and the right half portion 53B close to each other is installed on the elastic pressing member 53.

The retaining member 61 is configured to be slidable in the up-down direction with respect to the left half portion 53A and the right half portion 53B.

The retaining member 61 may be constructed by screwing a front member 61A installed on the front side of the left half portion 53A and the right half portion 53B, and a rear member 61B provided on the rear side of the left half 53A and the right half 53B.

By changing the position of the retaining member 61 in the up-down direction, the user may set the elastic pressing force exerted by the elastic pressing member 53 to an appropriate magnitude.

Next, the operation of the golf bag 1 and the frame 5 constructed in this way will be described.

When the golf bag 1 is erected with the opening 7 facing upward, as shown in FIG. 1, both the left leg 17A and the right leg 17B are in the stand-by position.

When the user grips the manipulation member 19 and pulls it rearward, the connecting member 51 hung around the rear surface of the manipulation member 19 is pulled rearward.

Accordingly, both left and right ends of the connecting member 51 are pulled, so that the left leg 17A and the right leg 17B are rotated about the corresponding rotational axes 41, respectively.

When the manipulation member 19 is pulled up to the rear position, the left leg 17A and the right leg 17B each have switched to the deployed position.

While maintaining the manipulation member 19 in the rear position, the user tilts the upper part of the golf bag 1 forward, so that the lower ends of the left leg 17A and the right leg 17B come into contact with the ground, respectively.

As a result, as shown in FIG. 5, the left leg 17A and the right leg 17B are opened, and the frame 5 and the golf bag body 3 are supported by the left leg 17A and the right leg 17B with their respective lower ends in contact with the ground.

Next, when the user tilts the front end of the golf bag 1 backward and raises the golf bag 1, the left leg 17A and the right leg 17B each rotate from the deployed position by the elastic pressing force of the elastic pressing member 53, and are switched downward to the stand-by position waiting for the deployment.

When the erected golf bag 1 is slightly tilted forward, the left leg 17A and the right leg 17B are respectively maintained at the stand-by position close to each other by the elastic pressing force of the elastic pressing member 53. Thus, it is possible to prevent the legs 17 from being unintentionally opened when the golf bag 1 is carried.

Next, effects of the golf bag 1 and the frame 5 constructed as described above will be described.

By operating the manipulation member 19 as described above, the left leg 17A and the right leg 17B may be simultaneously switched (moved) from the stand-by position to the deployed position.

Since the manipulation member 19 is installed to the upper frame 25, it is located on the upper portion of the frame body 15. For this reason, the manipulation for opening the legs 17 is easy compared to the case where the member to be operated to open the legs 17 is installed in the lower portion of the frame body 15.

Additionally, the legs 17 are located on the front side (one side) of the frame body 15, and the manipulation member 19 is located on the rear side (the other side) of the upper part of the frame body 15. For this reason, compared to the case where the manipulation member 19 is positioned in front of the upper portion of the frame body 15, the manipulation member 19 may be manipulated without hindering the movement of the legs 17 to the deployed position.

Since the connecting member 51 partially extends along the frame body 15 (specifically, the upper frame 25), the connecting member 51 is not disposed to traverse the opening 7 of the body when viewed from the top, and thus, it is possible to prevent the opening 7 of the golf bag body 3 from being narrowed by the connecting member 51.

Accordingly, it is easy to store golf clubs in the golf bag 1.

The upper frame 25 is constructed with a hollow pipe member, and the connecting member 51 is inserted into and pass through the respective insides of the left frame 25A and the right frame 25B of the upper frame 25.

Accordingly, since the connecting member 51 is not exposed, the design flexibility of the golf bag (and the frame 5) may be improved, and it is also possible to more reliably prevent the opening 7 of the golf bag body 3 from being narrowed by the connecting member 51.

The connecting member 51 is connected to the left and right legs 17 at its both ends, respectively, and its central portion is hung around the rear surface of the manipulation member 19.

For this reason, the user may simultaneously switch the two legs 17, i.e., the left leg 17A and the right leg 17B, to the deployed position by pulling the single manipulation member 19 backward.

In this embodiment, since the connecting member 51 is constructed with one wire, the number of fixing parts for fixing the wire may be reduced, simplifying the structure of the frame 5, compared to the case where the transmission member 49 is constructed with two wires, i.e., one wire connecting the manipulation member 19 and the left leg 17A, and the other wire connecting the manipulation member 19 and the right leg 17B.

Second Embodiment

Figure 8:
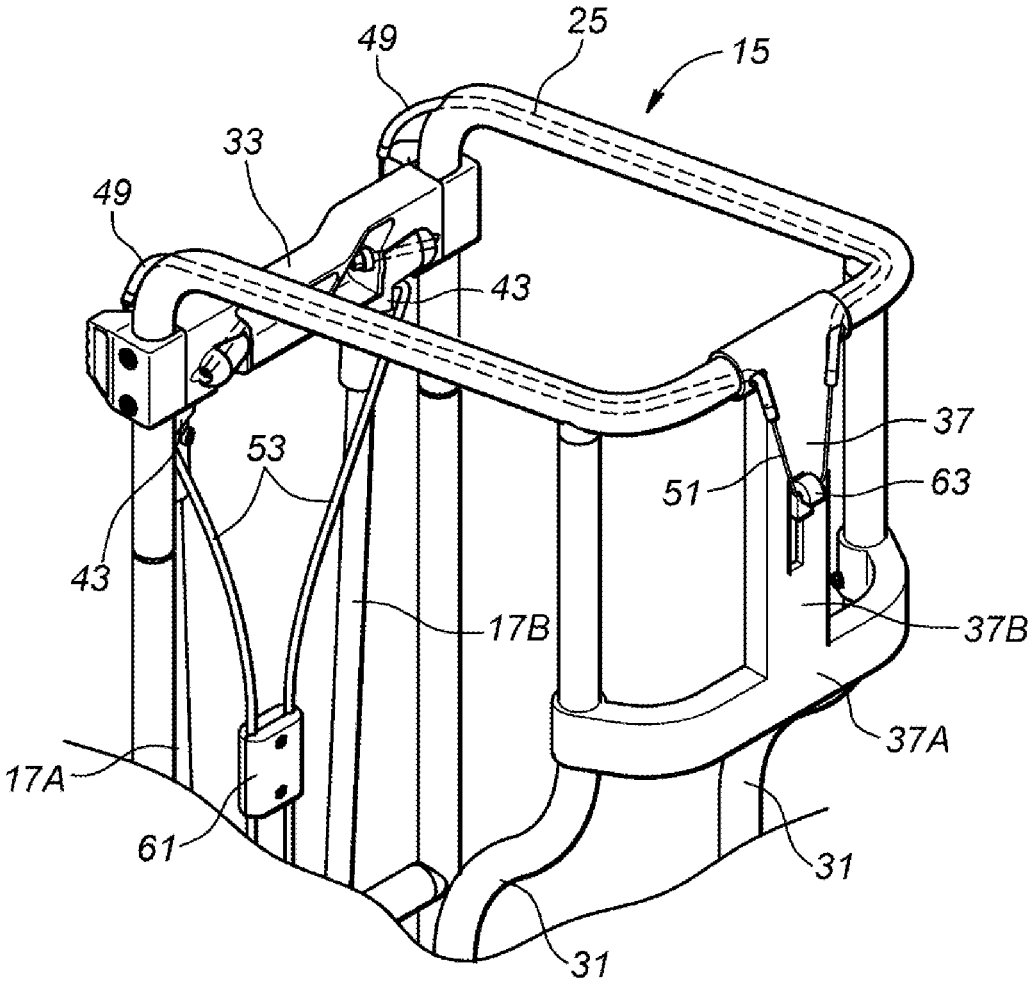
FIG. 8 is a rear perspective view of the upper portion of the frame of the golf bag according to the second embodiment.

As shown in FIG. 8, the golf bag 1 and the frame 5 for the golf bag 1 according to the second embodiment differ from the first embodiment in that the manipulation member 19 is installed to the third secondary part 37 with the different arrangement of connecting member 51, whereas the remaining configurations are the same as those of the first embodiment. Therefore, descriptions on the same configurations as those of the first embodiment will be omitted.

The manipulation member 19 is supported by the third secondary part 37 so as to be switchable in the up-down direction.

The manipulation member 19 may be provided with a protrusion 63 which protrudes rearward from the rear surface of the horizontal side portion 37B of the third secondary part 37.

The connecting member 51 is a wire-shaped member similarly to the first embodiment, and is coupled to the left leg 17A and the right leg 17B at both ends, respectively.

The coupling position of the connection member 51 and the left leg 17A and the coupling position of the connection member 51 and the right leg 17B may be the same as in the first embodiment.

The connecting member 51 is arranged to pass through the insides of the left frame 25A, the right frame 25B and the rear frame 25C of the upper frame 25.

The connecting member 51 is hung to the manipulation member 19 at the central portion.

When the left and right legs 17 are respectively in the stand-by position and the manipulation member 19 is pressed by the user, the central portion of the connecting member 51 is pulled downward.

As a result, the left and right ends of the connecting member 51 are pulled backward, and the left and right legs 17 are rotated, respectively, to be switched to the deployed position.

Next, effects of the golf bag 1 and the frame 5 for the golf bag 1 constructed as described above will be described.

The manipulation member 19 for opening the legs 17 is disposed on the upper portion of the frame body 15. With this structure, the user may open the legs 17 easily.

In addition, since the connection member 51 is arranged to pass through the inside of the upper frame 25, it is possible to prevent the opening 7 of the golf bag body 3 from being narrowed by the transmission member 49.

Third Embodiment

Figure 9:
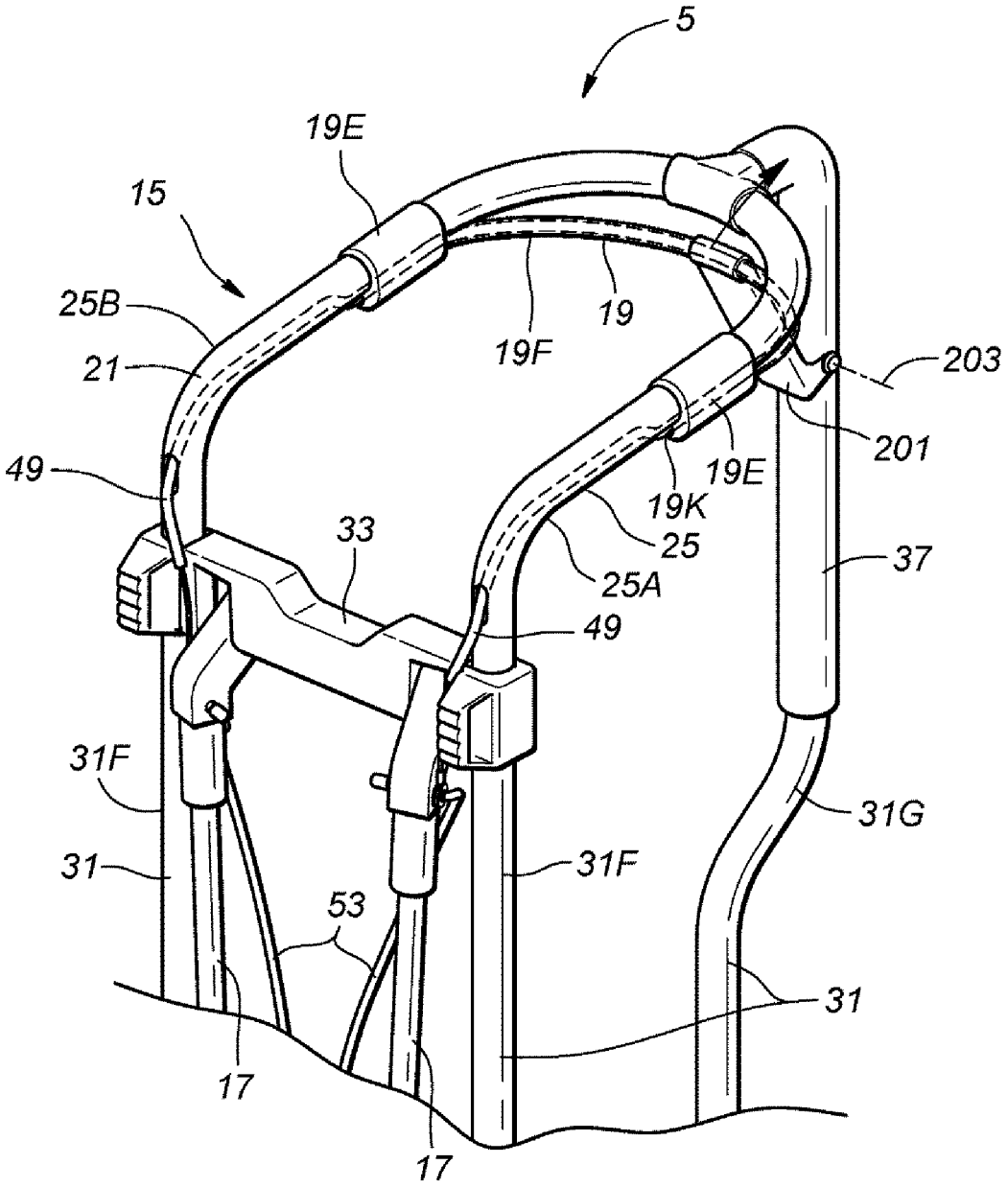
FIG. 9 is a front perspective view of the upper portion of the frame of the golf bag according to the third embodiment.

As shown in FIG. 9, the golf bag 1 and the frame 5 for the golf bag 1 according to the third embodiment differ with regard to the structure of each of the post 31 and the third secondary part 37, and differ in that a grip member 201 connecting the manipulation member 19 and the post 31 is formed instead of the grip 19D, whereas the remaining configurations are the same as those of the first embodiment. Therefore, descriptions on the remaining configurations will be omitted.

The frame body 15 is provided with the primary part 21 constructed by a pipe member, the first secondary part 33, and the second secondary part 35 (not shown), wherein the couples are coupled to the primary part 21. The first secondary part 33 and the second secondary part 35 are the same as those in the first embodiment.

As in the first embodiment, the primary part 21 includes the upper frame 25, a lower frame 27 (not shown), and a plurality of posts 31.

As in the first embodiment, the upper frame 25 extends along the side edge of the opening 7 of the golf bag body 3.

The upper frame 25 is constructed with a hollow pipe member, and the transmission member 49 is inserted into the inside of the upper frame 25 through the through-holes 55 and passes through it, as in the first embodiment.

In this embodiment, the primary part 21 is provided with a pair of left and right front posts 31F located on the front side of the frame body 15, and one rear post 31G located on the rear side of the frame body 15.

The front posts 31F exhibit the same functions as the third post 31C and the fourth post 31D of the first embodiment, respectively.

The rear post 31G is coupled to the rear end of the upper frame 25, specifically, to the left-right central portion of the rear frame 25C.

After extending backward from the upper frame 25, the rear post 31G extends downward and is connected to the lower frame 27.

The third secondary part 37 is installed on the upper portion of the rear post 31G.

The third secondary part 37 has a cylindrical shape covering the outer surface of the upper portion of the rear post 31G.

As in the first embodiment, the upper frame 25 is provided with the left frame 25A and the right frame 25B in a left-right pair (collectively, the left and right frames), and the rear frame 25C, and has a U-shape when viewed from the top.

The left frame 25A and the right frame 25B each extend in the front-rear direction, and the rear frame 25C connects the rear end of the left frame 25A and the rear end of the right frame 25B.

The manipulation member 19 is supported between the left frame 25A and the right frame 25B so as to be slidable in the front-rear direction on the left frame 25A and the right frame 25B, respectively.

Similar to the first embodiment, when the manipulation member 19 is in the front position, the two legs 17 are each closed and stand-by position.

When the manipulation member 19 is in the rear position, which is further rearward than the front position, the two legs 17 are in the open and deployed position.

In this embodiment, the manipulation member 19 is provided with a pair of left and right coupling portions 19E and a connecting portion 19F connecting the left and right coupling portions 19E.

The coupling portions 19E extend along the left frame 25A and the right frame 25B, respectively, and are slidably coupled to the left frame 25A and the right frame 25B, respectively.

Figure 10:
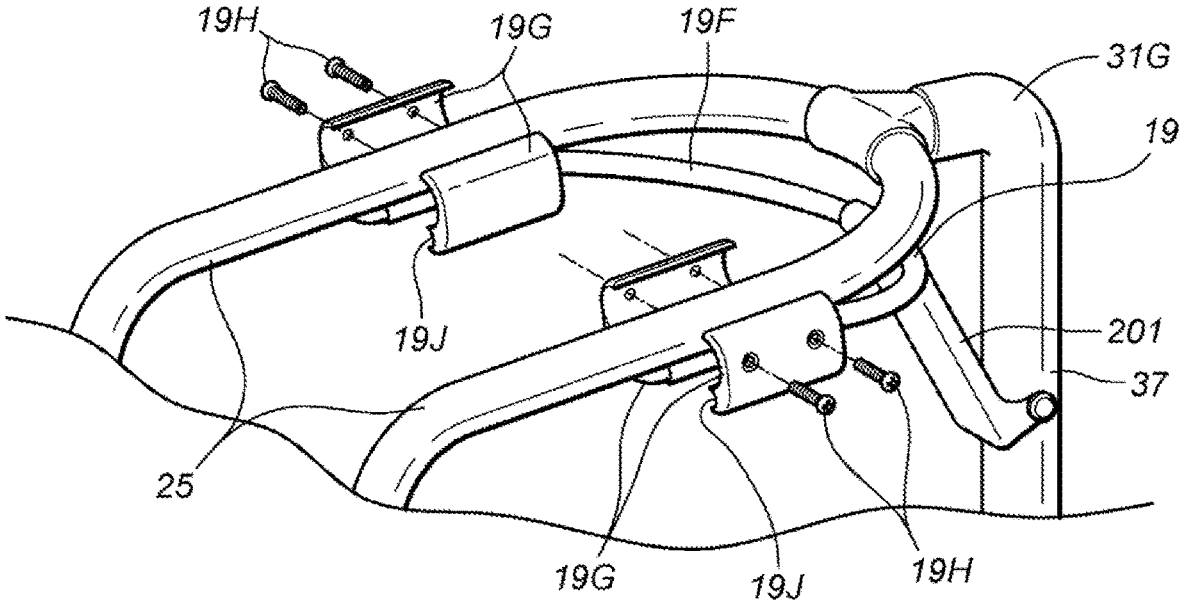
FIG. 10 is an exploded perspective view of a portion of a manipulation member according to a third embodiment.

FIG. 10 shows an exploded perspective view of the coupling portions 19E.

As shown in FIG. 10, each of the engaging portions 19E is constructed by coupling two half cylindrical members 19G with screws 19H.

In the lower portion of the cylindrical member 19GA, a groove 19J is formed for accommodating the transmission member 49.

By coupling the two cylindrical members 19G, a through-hole 19K is formed for accommodating the transmission member 49.

When the coupling portions 19E are coupled to the upper frame 25, the through-holes 19K extend along the left frame 25A and the right frame 25B, respectively.

The connecting portion 19F is constructed with a line-shaped member forming a U letter shape with its opening toward the front when viewed from the top.

The both ends of the connecting portion 19F are coupled to the coupling portions 19E, respectively.

The connecting portion 19F may be configured such that it may elastically deform according to the load applied to its rear end.

The connecting portion 19F has a pipe shape which forms therein one through-hole (not shown) communicating with the through hole 19K of the coupling portion 19E on the left side and the through hole 19K of the coupling portion 19E on the right side.

The transmission member 49 is inserted into and passes through each of the through-hole 19K of the coupling portion 19E on the left side, the through-hole of the connecting portion 19F, and the through-hole 19K of the coupling portion 19E on the right side.

Accordingly, as shown in FIG. 9, the transmission member 49 is arranged along the left frame 25A and the right frame 25B inside the coupling portions 19E of the manipulation member 19.

The grip member 201 connects the manipulation member 19 and the rear post 31G.

The grip member 201 is rotatably coupled to the rear post 31G.

In this embodiment, the upper end of the grip member 201 is coupled to the rear edge of the manipulation member 19, and the lower end of the grip member is rotatably coupled to the rear post 31G about an axis 203 extending in the left-right direction.

The grip member 201 may be coupled with the manipulation member 19 in any form, as long as it is coupled with the manipulation member 19 so as not to interfere with the switching between the front and rear positions of the manipulation member 19.

For example, when the connecting portion 19F is elastically deformable by the switching between the front and rear positions of the manipulation member 19, the manipulation member 19 and the grip member 201 may be securely fixed to each other.

In addition, the grip member 201 may be provided with a through-hole formed at the upper end so as to allow the insertion therethrough of the connecting portion 19F and extend in the left-right directions, and the connecting portion 19F may be inserted into and pass through this through-hole.

Accordingly, the connecting portion 19F may be slidably coupled to the grip member 201 in the left-right direction.

Next, effects of the golf bag 1 and the frame 5 for the golf bag 1 constructed as described above will be described.

When the user grips the grip member 201 and the rear post 31G, the grip member 201 rotates about the lower end so that the upper end is moved rearward (see the arrow in FIG. 9), and the manipulation member 19 is moved rearward.

Accordingly, the manipulation member 19 is moved from the front position to the rear position, and the legs 17 are each moved from the stand-by position to the deployed position.

When the user releases the grip member 201 and the rear post 31G, the legs 17 are each moved from the deployed position to the stand-by position due to the elastic pressing force of the elastic pressing member or gravity, as in the first embodiment.

As described above, since the manipulation member 19 may be moved rearward by gripping the grip member 201 and the rear post 31G, the user may easily operate the legs 17.

While until now the descriptions of specific embodiments have been provided, the present disclosure is not limited to the above-described embodiments or modified examples, but may be practiced in the form of a variety of modifications.

The specific configuration, arrangement, number or amount of each member or site, specific control scheme, or the like may be appropriately changed within a range that does not depart from the technical idea of the present disclosure.

In the above-described embodiments, no wheels are installed in the frame body 15, but it may be contemplated that a pair of left and right wheels are installed in the lower portion of the frame body 15.

The left and right wheels may be configured to be prevented from rotating when the left leg 17A and the right leg 17B are both in the deployed position.

Accordingly, when the frame 5 and the golf bag body 3 are supported by the left leg 17A and the right leg 17B, the rotation of the wheels may be prevented.

In the third embodiment, the rear post 31G is formed to extend backward from the upper end and then extend downward, but its structure is not limited to this.

Figure 11:
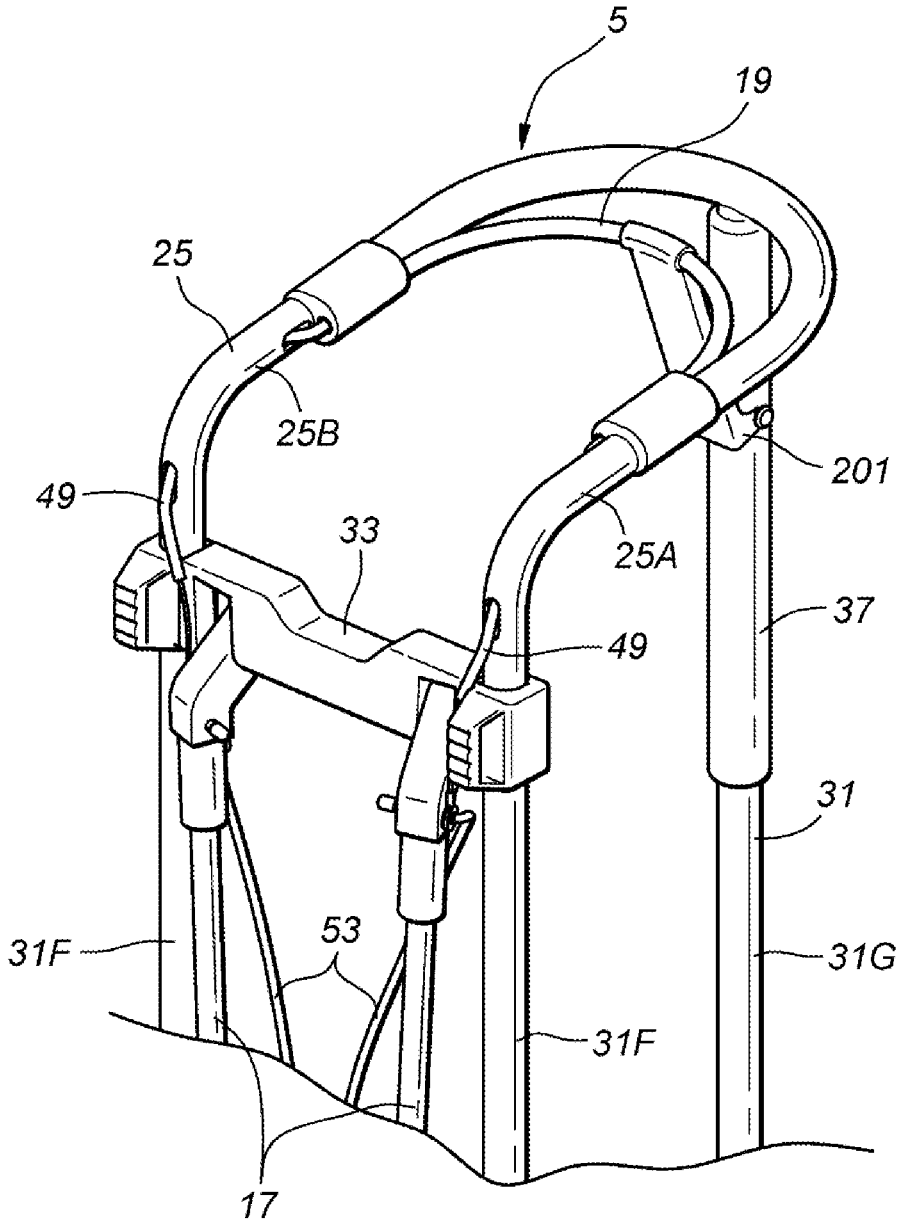
FIG. 11 shows an example in which the frame of the golf bag according to the third embodiment is modified.

As shown in FIG. 11, the rear post 31G may be formed to extend downward directly from the upper frame 25.

In the third embodiment, three posts are installed in the primary part 21, but the present disclosure has no restriction to the number of posts.

Figure 12:
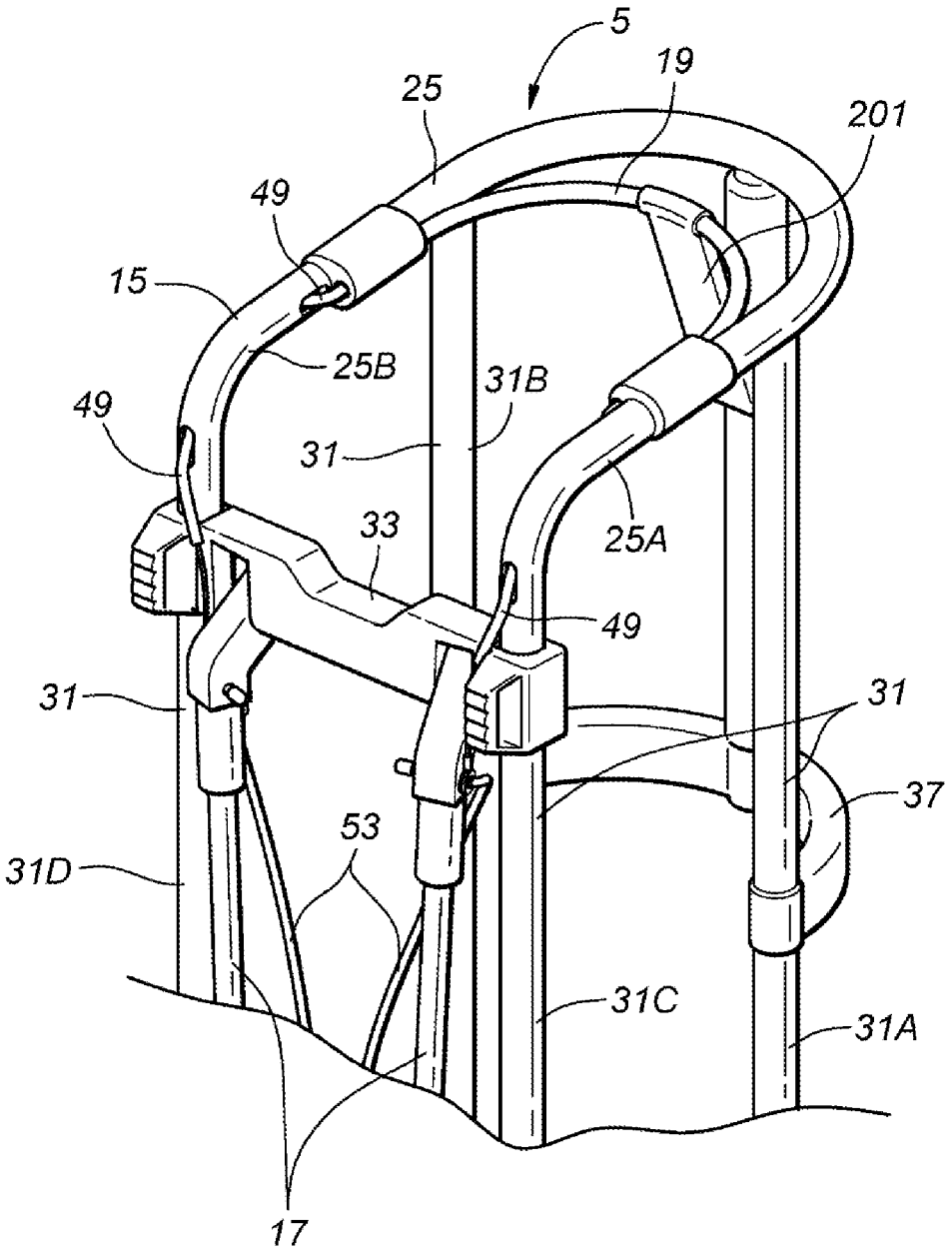
FIG. 12 shows an example in which the frame of the golf bag according to the third embodiment is modified.

For example, as in the first embodiment, the primary part 21 may be provided with four posts 31, as shown in FIG. 12. In this case, the same third secondary part 37 as in the first embodiment may be installed to the posts 31 disposed on the rear side of the frame body 15.

Additionally, in the above-described first embodiment, the first post 31A and the second post 31B are each constructed to be coupled to the upper frame 25 at their upper ends, but their structures are not limited to this form.

Figure 13:
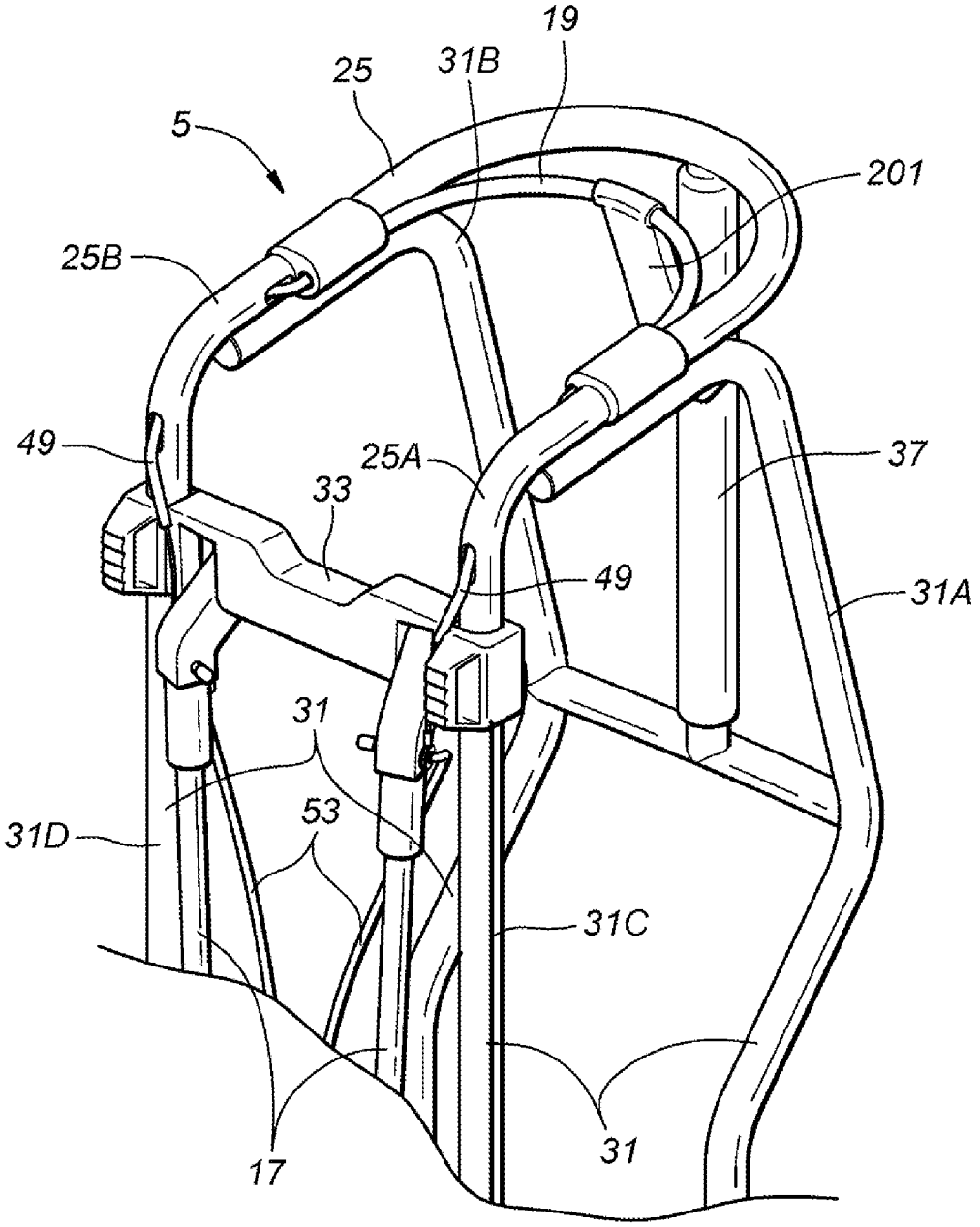
FIG. 13 shows an example in which the frame of the golf bag according to the third embodiment is modified.

For example, as shown in the modified example of the third embodiment in FIG. 13, the upper ends of the first post 31A and the second post 31B may be bent so as to extend along the lower edges of the upper frame 25, respectively, and may be coupled to the lower edges of the upper frame 25 (specifically, the left frame 25A and the right frame 25B), respectively.

Further, as shown in FIG. 13, the first post 31A and the second post 31B may each be bent at the coupling portions with the upper frame 25, extend downward in a direction inclined rearward, and then extend downward in a direction inclined forward, and may be coupled to the lower frame 27 (not shown).

In the above-described embodiments, the case where at least a part of the transmission member 49 extends along the edge of the opening 7 has been described by way of example, but the present disclosure is not limited to this form.

The entire length of the transmission member 49 may extend along the edge of the opening 7, and it is also possible for the transmission member 49 to have any arrangement as long as it does not traverse the central portion of the opening 7.

Specifically, for example, the transmission member 49 may be arranged to extend along a position offset downwardly from the edge defining the opening 7.

The transmission member 49 may at least partially extend along an outer edge of a member constituting the golf bag body 3 (such as a sheet-shaped member, a resin member or the like).

Additionally, the transmission member 49 may at least partially extend along the inner edge of the member constituting the golf bag body 3.

Besides, the transmission member 49 may be at least partially accommodated inside the member constituting the golf bag body 3.

Further, the present disclosure has no restriction to the up-down direction length of the golf bag body 3, the size and shape of the opening 7 or the like.

Besides, the present disclosure has no restriction to the number of clubs accommodated in the golf bag 1.

In the above-described embodiments, an example in which the present disclosure is applied to the golf bag 1 constituting a caddie bag has been described, but the present disclosure may be applied to any bag for accommodating golf clubs.

For example, the golf bag 1 may also constitute a case (a so-called golf club case) used for the user to select and carry one or several golf clubs, in addition to the so-called caddie bag.

REFERENCE SIGN LIST

1: golf bag
3: golf bag body
5: frame
7: opening
15: frame body
17: leg
17A: left leg
17B: right leg
19: manipulation member
19D: grip (grip portion)
25: upper frame
25A: left frame
25B: right frame
49: transmission member
53: elastic pressing member
201: grip member

What is claimed is:

1. A golf bag comprising:

a golf bag body into which a golf club is inserted;

a frame body supporting the golf bag body with an opening of the golf bag body located on an upper side, wherein the frame body includes an upper frame extending along a side edge of the opening of the golf bag body;

a pair of legs rotatably supported on one side of the frame body to switch between a stand-by position and a deployed position where the pair of legs are capable of supporting the frame body;

a manipulation member installed at the upper frame of the frame body so as to be switchable in a predetermined direction; and a transmission member at least partially extending along the side edge of the opening, so that the legs can be switched from the stand-by position to the deployed position by switching the manipulation member, wherein the transmission member includes a portion extending along the upper frame, the upper frame has a pair of left and right frames disposed on a left and right sides of the golf bag body, the manipulation member is supported on both of the left and right frames between the left and right frames so as to be switchable between a front position where the legs are in the stand-by position and a rear position where the legs are in the deployed position, the transmission member is connected to the legs at its both ends, and is hung to the manipulation member, the manipulation member includes a lever or a handle, the transmission member includes a connecting member which connects the manipulation member with the legs, and the manipulation member is configured to be moved so that the connecting member is pulled, and the legs are rotated about predetermined rotational axes, switching from the stand-by position to the deployed position.

2. The golf bag of claim 1, wherein the upper frame is constructed with a hollow pipe member, and wherein the transmission member is inserted into and passes through the inside of the upper frame.

3. The golf bag of claim 1, wherein a post extending downward is installed at an end of said another side of the upper frame, and wherein the manipulation member and the post are connected via a grip member.

4. The golf bag of claim 1, wherein the manipulation member is provided with a grip portion extending downward from an end of said another side.

5. The golf bag of claim 1, wherein the frame body is further provided with an elastic pressing member for elastically pressing the legs toward the stand-by position, and the elastic pressing member includes a torsional coil spring installed on the predetermined respective rotational axes the legs.

6. A frame for a golf bag, the frame comprising:

a frame body supporting a golf bag body with an opening of the golf bag body located on an upper side, wherein a golf club is inserted into the golf bag body, and the frame body includes an upper frame extending along a side edge of the opening of the golf bag body;

a pair of legs rotatably supported on one side of the frame body to switch between a stand-by position and a deployed position where the pair of legs are capable of supporting the frame body;

a manipulation member installed at the upper frame of another side of the frame body so as to be switchable in a predetermined direction; and a transmission member at least partially extending along the side edge of the opening, so that the legs can be switched from the stand-by position to the deployed position by switching the manipulation member, wherein the transmission member includes a portion extending along the upper frame, the upper frame has a pair of left and right frames disposed on the left and right sides of the golf bag body, the manipulation member is supported on both of the left and right frames between the left and right frames so as to be switchable between a front position where the legs are in the stand-by position and a rear position where the legs are in the deployed position, the transmission member is connected to the legs at its both ends, and is hung to the manipulation member, the transmission member is connected to the legs at its both ends, and is hung to the manipulation member, the manipulation member includes a lever or a handle, the transmission member includes a connecting member which connects the manipulation member with the legs, and the manipulation member is configured to be moved so that the connecting member is pulled, and the legs are rotated about predetermined rotational axes, switching from the stand-by position to the deployed position.

7. The golf bag of claim 2, wherein the frame body is further provided with an elastic pressing member for elastically pressing the legs toward the stand-by position, and the elastic pressing member includes a torsional coil spring installed on the predetermined respective rotational axes the legs.

8. The golf bag of claim 3, wherein the frame body is further provided with an elastic pressing member for elastically pressing the legs toward the stand-by position, and the elastic pressing member includes a torsional coil spring installed on the predetermined respective rotational axes the legs.

* * * * *